US005417433A

United States Patent [19]

Phillips

[11] Patent Number: 5,417,433

[45] Date of Patent: May 23, 1995

[54] VENTILATED GAMING TABLE ASSEMBLY

[76] Inventor: Donald A. Phillips, 1404 NE. 69th, Portland, Oreg. 97213

[21] Appl. No.: 279,357

[22] Filed: Jul. 25, 1994

[51] Int. Cl.[6] ..... A63F 9/00; A47B 25/00; F24F 9/00

[52] U.S. Cl. ..... 273/309; 273/287; 454/230; 454/306; 454/338; 55/385.1; 55/DIG. 18

[58] Field of Search ..... 273/309, 292, 274, 287; 454/230, 306, 338; 131/242, 231; 55/385.1, 385.8, DIG. 18, DIG. 19

[56] References Cited

U.S. PATENT DOCUMENTS

| | | | |
|---|---|---|---|
| 2,555,547 | 6/1951 | Kelleghan | 273/309 |
| 2,572,120 | 10/1951 | Dixon | 454/230 |
| 2,709,954 | 6/1955 | Baker | 454/60 |
| 3,715,122 | 2/1973 | Brown | 273/309 |
| 4,248,162 | 2/1981 | Skeist | 454/230 |
| 4,580,582 | 4/1986 | Grube et al. | 131/231 |
| 4,623,367 | 11/1986 | Paulson | 55/385 R |

*Primary Examiner*—Benjamin H. Layno
*Attorney, Agent, or Firm*—Eugene D. Farley

[57] ABSTRACT

A ventilated gaming table assembly includes a gaming table component, a rail component and a plurality of electric ventilating fan subassemblies mounted about the periphery of the table and operable selectively by individual players.

5 Claims, 1 Drawing Sheet

VENTILATED GAMING TABLE ASSEMBLY

BACKGROUND OF THE INVENTION

1. Field of the Invention

This invention relates to a gaming table or like device equipped with provision for the selective removal of tobacco smoke from the vicinity of the players.

2. Description of the Prior Art

The annoyance and possible adverse physical effect resulting from the practice of smoking at gaming tables such as those employed when playing poker and baccarat are well known.

It is the general purpose of the present invention to provide a ventilated gaming table assembly which overcomes the problem and which enables the players to enjoy their activity free from the discomfort and hazard resulting from exposure to tobacco smoke.

It is still a further object of the present invention to provide such a table which is provided with a plurality of playing stations, each equipped with its own ventilating device for individual control of the environment immediately adjacent to the station.

Still a further object of the invention is the provision of such a table characterized by the presence of a cooling current of air at each playing station, at the volition of each player.

It is another feature of the invention that it may be applied to conventional rail-equipped gaming tables with but slight modification and minimum additional expense.

SUMMARY OF THE INVENTION

The foregoing and other objects of my invention are accomplished by means of a ventilated gaming table assembly which, broadly considered, comprises a gaming table component and a rail component. The rail component is supportably superimposable on the table component to provide a plurality of peripherally spaced playing stations.

A plurality of electric ventilating fan subassemblies are mounted, one at each playing station. Each of the fan subassemblies is controlled individually by the person who occupies the associated playing station. It acts to dispel and deliver to the house ventilation system any tobacco smoke or other fumes which may be present in the vicinity.

THE DRAWINGS

DETAILED DESCRIPTION OF THE INVENTION

Figure 1:
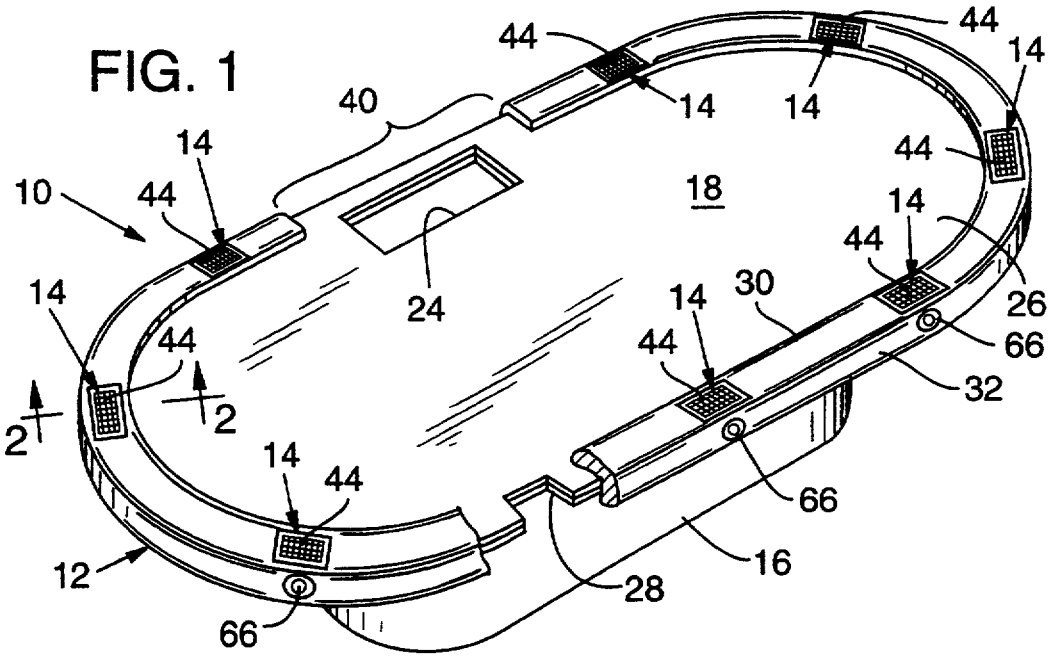
FIG. 1 is a top perspective view of the ventilated gaming table assembly of my invention, partly broken away to show interior construction.

As indicated above, the ventilated gaming table assembly of my invention basically comprises a gaming table component indicated generally at 10, a rail component indicated generally at 12, and a plurality of electric fan subassemblies each of which is indicated generally at 14.

Table 10 is of the style conventionally used in playing poker, baccarat, etc. It consists basically of a pedestal 16 or other support member supporting a flat top 18 fabricated from any suitable structural material such as a pair of plywood sheets 20, 22. Along ,one margin there is provided an opening 24, FIG. 1, which accommodates the dealer's cash box or other paraphernalia.

The upper surface of the table top may be covered with the usual layer of felt cloth 26, At spaced intervals about its periphery, the margin of the table top is cut away to provide at each playing station a marginal recess 28.

Rail component 12 is designed to protect and embellish the table margin by providing surfaces against which the table patrons can lean, or on top of which they may rest hands and elbows. It comprises a length of durable plastic which is L-shaped in cross section. There thus are provided a top or upper surface segment 30 and a skirt segment 32. Styrofoam (or other) pads 34, 36, 38 underlie the rail at strategic locations. Framing members: 60, 62 rigidify the rail structure.

The rail is discontinuous to provide a dealer's station 40, FIG. 1, opposite the dealer's cash box opening 24.

Figure 2:
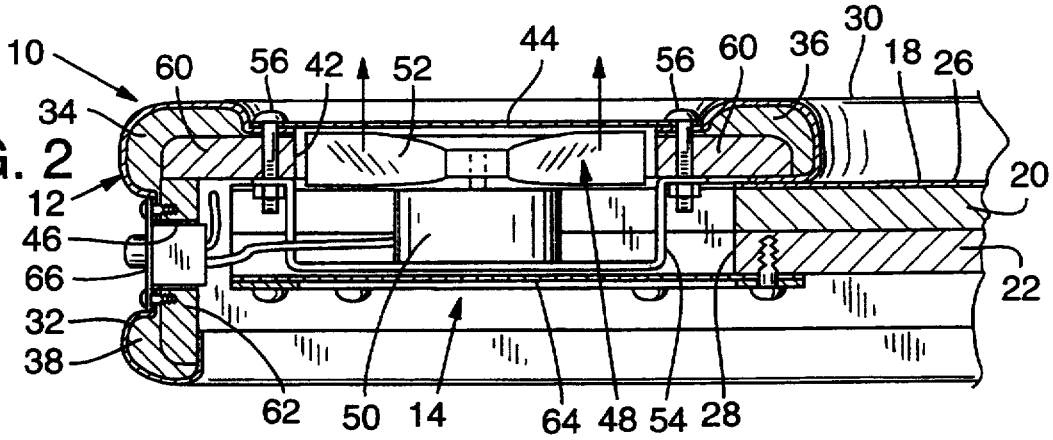
FIG. 2 is a fragmentary, detailed, sectional view taken along line 2—2 of FIG. 1.

The entire rail assembly is designed for removable gravitational placement on the underlying table, FIG. 2. Releasable locking means, not illustrated, may be provided for releasably securing the one to the other during use.

Rail top segment 30 is provided with a plurality of spaced openings 42 each of which registers with one of cutout recesses 28 in table top 18. Each such opening mounts a screen 44.

Skirt 32 of rail 12 is provided with a plurality of openings 46. These preferably are immediately below screens 44. Together with the screens they mark off the periphery of the table into a plurality of spaced playing stations, each designed to accommodate one player.

An electric fan 48 is seated in each of the openings provided by registering recesses 28 in the table top and openings 42 in the rail.

The fan consists of an electric motor 50 with associated fan blade 52. The latter element preferably is arranged so that it directs the flow of air upwardly through the associated screen 44. This drives any smoke which may be present upwardly into cooperating ventilating duct work in the ceiling of the room. It also provides a pleasant current of cool air for the refreshment of the player(s) standing or sitting nearby.

Appropriate mounting means are provided for mounting each of fans 50 in its associated recess.

As illustrated in FIG. 2, one such means comprises a bracket 54 which is supported by bolts 56 on rail 12 in the indicated sandwich assembly which includes also frame member 60 and screen 44.

A bottom screen 64 protects the fan intake at the bottom of the fan subassembly.

Figure 3:
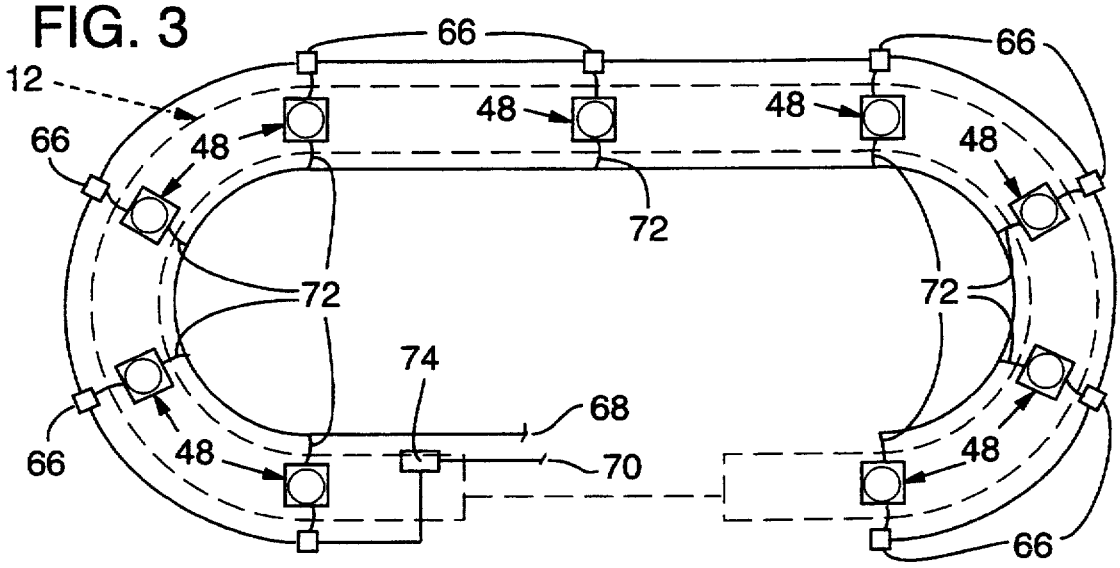
FIG. 3 is a schematic view of the circuitry employed in the assembly.

Fans 48 are individually controllable by means of an electric circuit illustrated in FIG. 3.

Electric switches 66 are mounted in skirt openings 46 and vertical frame member 62 in the manner illustrated in FIG. 2. They are included in parallel circuit relationship in an electric circuit including house lines 68, 70 and branch lines 72.

A master switch 74 is placed in series in the circuit. It is located adjacent the dealer for energizing and deenergising the individual player switches when such is desired.

In operation, after master switch 74 has been actuated, each individual player can operate the adjacent fan assembly 14 by operating the player switch 66 which is immediately adjacent his station. As a result, any smoke in the player's immediate vicinity is dispersed and driven upwardly toward the ceiling, where it is collected by the air conditioning system of the building.

Having thus described in detail preferred embodiments of the present invention, it will be apparent to those skilled in the art that many physical changes may be made without altering the inventive concepts and principles. The present embodiments are therefore to be considered in all respects as illustrative and not restrictive, the scope of the invention being indicated by the appended claims.

I claim:

1. A ventilated gaming table assembly comprising in combination:

a ) a gaming table component, b) a rail component, c) the rail component being supportably superimposable on the table component to provide a gaming table assembly having a plurality of peripherally spaced playing stations, d) a plurality of electric ventilating fan subassemblies, e) a plurality of mounting means mounting the fan subassemblies, on the table one at each station, and f) an electric circuit including the fan subassemblies and electric switch means arranged for selective operation of the same by individual players, g) the electric switch means comprising a plurality of electric switches arranged in parallel circuit arrangement, one at each playing station.

2. The ventilated gaming table assembly of claim 1 wherein the rail component comprises a length of structural material contoured and dimensioned for superimposition on the table component.

3. The ventilated gaming table assembly of claim 1 wherein at each playing station the gaming table component and the rail component are cut away to form registering recesses providing a seat for the fan subassembly mounting means.

4. The ventilated gaming table assembly of claim 3 wherein each electric ventilating fan subassembly comprises an electric fan, and bracket mounting means mounting the same in the registering recesses.

5. The ventilated gaming table assembly of claim 1 including a master switch in series circuit relationship in the electric circuit.

* * * * *